US005685038A

United States Patent [19]

Smith et al.

[11] Patent Number: 5,685,038

[45] Date of Patent: Nov. 11, 1997

[54] OUT-OF-BALANCE CONTROL FOR WASHING MACHINE

[75] Inventors: Richard G. Smith, Caledonia, Wis.; Kenyon A. Hapke, Libertyville, Ill.; Spencer C. Schantz, Dousman, Wis.

[73] Assignee: U.S. Controls Corporation, New Berlin, Wis.

[21] Appl. No.: 444,596

[22] Filed: May 18, 1995

[51] Int. Cl.[6] ..... D06F 33/02

[52] U.S. Cl. ..... 8/159; 68/23.3; 68/12.06; 200/61.48

[58] Field of Search ..... 68/12.06, 23.1, 68/12.24, 23.3, 23.2; 210/144; 494/82; 200/61.7, 61.76, 61.48, 61.52, 48, 49, 85 R; 34/58; 8/159

[56] References Cited

U.S. PATENT DOCUMENTS

| | | | |
|---|---|---|---|
| 2,311,545 | 2/1943 | Hurley et al. | 68/12.06 |
| 2,311,924 | 2/1943 | Bassett, Jr. | 68/23.1 |
| 3,098,372 | 7/1963 | Bochan | 68/12.06 |
| 3,815,082 | 6/1974 | Schantz et al. | 339/221 |
| 3,958,094 | 5/1976 | Schantz et al. | 200/283 |
| 4,311,891 | 1/1982 | Faust | 200/61.48 |
| 4,455,461 | 6/1984 | Maguire | 200/61.48 |
| 4,496,809 | 1/1985 | Faust et al. | 200/61.48 |
| 4,910,502 | 3/1990 | Serveau et al. | 68/23.2 |

FOREIGN PATENT DOCUMENTS

| | | | |
|---|---|---|---|
| 841584 | 6/1952 | Germany | 68/23.2 |
| 63-29694 | 7/1986 | Japan | 68/23.1 |
| 1044271 | 9/1966 | United Kingdom | 68/23.1 |

*Primary Examiner*—Frankie L. Stinson
*Attorney, Agent, or Firm*—Quarles & Brady

[57] ABSTRACT

An acceleration sensitive switch for use in detecting an out-of-balance condition on a residential washing machine, or the like, uses a pendulum activated switch wherein the pendulum is biased against an energy absorbing stop by a predetermined threshold force corresponding to the desired switching acceleration. The geometry of the spring and pendulum are such that the restoring force decreases as the pendulum moves to activate the switch providing positive switching action and permitting simple calibration of the unit.

12 Claims, 2 Drawing Sheets

FIG. 3
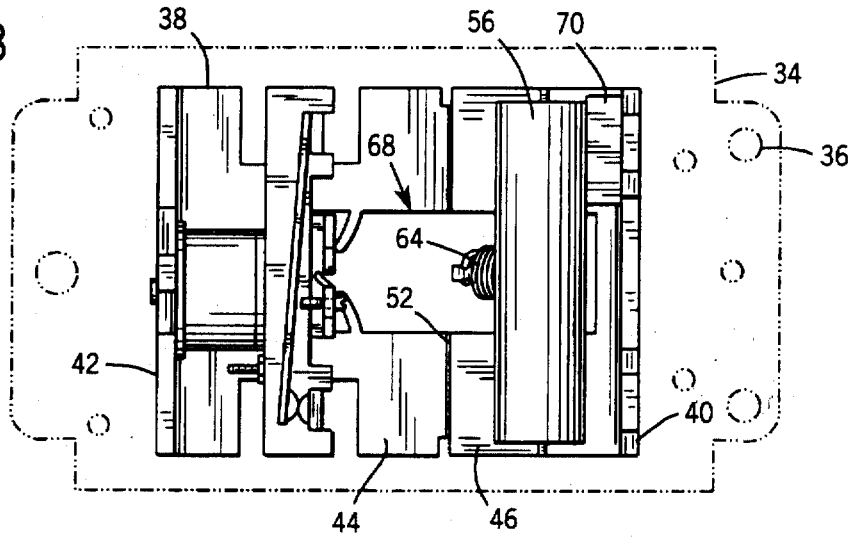
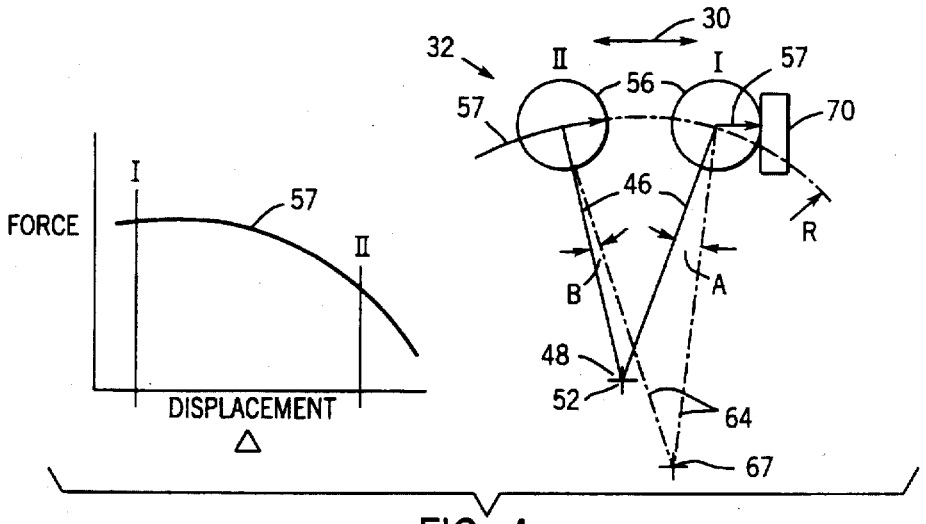
FIG. 4
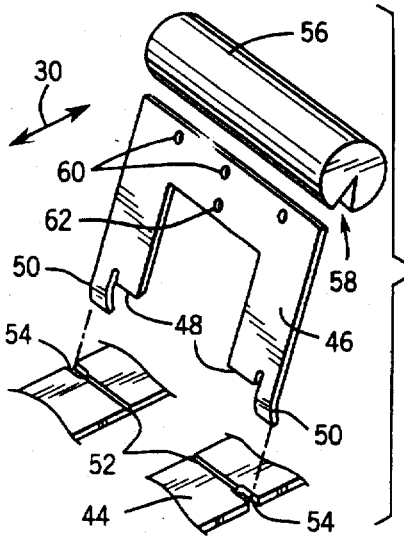
FIG. 5
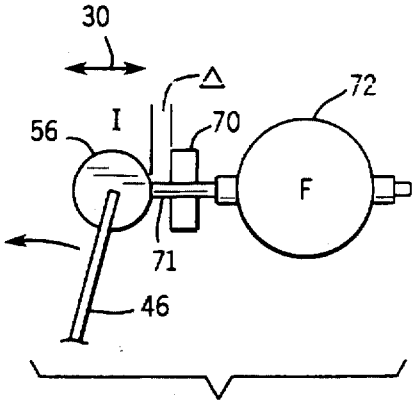
FIG. 6

OUT-OF-BALANCE CONTROL FOR WASHING MACHINE

FIELD OF THE INVENTION

The present invention relates to residential clothes washing machines, and in particular to electrical switches used to stop the operation of such machines when an out-of-balance condition occurs. Specifically, the present invention provides a rugged and inexpensive acceleration-sensitive switch that may be activated by a predetermined level of acceleration associated with eccentric movement of the washing machine tub.

BACKGROUND OF THE INVENTION

Top loading residential washing machines have an upwardly opening tub into which clothes may be placed for cleaning. During operation, the tub and its internal spin basket are filled with water, via a solenoid valve, and a central agitator within the tub agitates the clothes and water to separate the dirt from the fabric (the "agitation cycle"). At the conclusion of the agitation cycle, the water is drained from the tub and the spin basket is spun about its axis to remove water from the wet clothes by centrifugal force (the "spin cycle").

During the spin cycle, if the wet clothes are unevenly distributed about the axis of the spin basket, the rapidly rotating spin basket may become unbalanced. Minor unbalance is accommodated by mounting the tub (including the spin basket) to "float" with respect to the frame of the washing machine, i.e., so that some movement between the two can occur. Such a floating mounting system may, for example, suspend the tub from the top of the washing machine on one or more pivoting links.

Even with such floating mounting systems, only a limited range of relative motion between the tub and the machine may be accommodated. For severely out-of-balance loads, the movement of the tub will be great enough that the limits of travel of the mounting system will be exceeded. In this case, the out-of-balance tub may impart sufficient force to the washing machine to cause it to walk or shake unacceptably or the tub may strike the frame of the washing machine potentially damaging the machine itself. For this reason, it is desirable to provide a switch that responds to a severe out-of-balance condition to stop rotation of the spin basket so the user can redistribute the wet clothes.

This function of stopping the out-of-balance spin cycle has previously been accomplished by a "kickout" switch positioned just outside the outer excursions of the tub during mildly out-of-balance operation. During severe out-of-balance operation, the kickout switch is struck by the swinging of the tub and opens the motor circuit stopping the spin cycle. Such kickout switch is described in U.S. Pat. No. 3,958,094 assigned to the assignee of the present invention and hereby incorporated by reference.

SUMMARY OF THE INVENTION

The present invention provides an alternative to prior art kickout switches employing the fact that an out-of-balance tub not only travels outside of an expected range of motions, but also experiences accelerations exceeding those expected during balanced operation. The present invention provides a switch that can be precisely set to change state at a given acceleration and which may be mounted directly on the tub to detect out-of-balance conditions.

Specifically, the present invention provides an out-of-balance control for detecting lateral tub motion. The switch includes a weight mounted for movement in the lateral is direction between a rest position and an activation position. Switch contacts, positioned at the activation position, are opened when the weight has moved to the actuation position. A stop located at the rest position contacts the weight when the weight has moved to the rest position, and a spring attached to the weight biases the weight against the stop with a threshold force. The stop may be an energy absorbing elastomer.

It is one object of the invention to provide a switch which is relatively insensitive to accelerations below a predefined threshold, but that is activated by accelerations above that threshold. By biasing the weight against the energy absorbing stop, low amplitude accelerations do not cause weight movement. This is true even if the low amplitude accelerations are periodic at the natural frequency of the weight and spring, and otherwise might be expected to excite the weight into a resonant swinging over several acceleration cycles.

The spring may be attached to the weight so that the force returning the weight to the rest position decreases as the weight moves away from the rest position.

Thus, it is another object of the invention to provide a switch that is rapidly actuated. Once the threshold acceleration is reached, the weight rapidly moves to the actuation position.

It is another object of the invention to provide a simple mechanism for measuring a predetermined threshold of acceleration that may be simply calibrated without the need for complex shaker tables or the like. Because the maximum restoring force on the weight is present when the weight is at the rest position, the threshold acceleration triggering the switch may be precisely determined by measuring the biasing force of the spring at this single rest position. It follows that this threshold acceleration may be calibrated by adjusting this force while the switch is at the single rest position. Complex measurements of the spring force over the range of travel of the weight are avoided.

The weight may be mounted on a pivoting arm to move in the lateral direction about a fulcrum point on a housing where the spring is attached in tension between a first mounting point near the weight, and a second mounting point on the housing between the weight and fulcrum point to draw the arm toward the fulcrum. The fulcrum mechanism may be provided by a knife edge on the pivoting arm drawn to the fulcrum point by the force of the spring.

Thus, it is another object of the invention to provide a simple mechanism for implementing an acceleration sensitive switch suitable for use with a washing machine.

The foregoing and other objects and advantages of the invention will appear from the following description. In the description, reference is made to the accompanying drawings which form a part hereof and in which there is shown by way of illustration, a preferred embodiment of the invention. Such embodiment does not necessarily represent the full scope of the invention, however, and reference must be made therefore to the claims herein for interpreting the scope of the invention.

BRIEF DESCRIPTION OF THE DRAWINGS

FIG. 3 is a top plan view of the switch of FIG. 2 with a top mounting plate drawn in phantom for clarity;

FIG. 4 is a plot of force versus displacement of the pendulum of FIGS. 2 and 3 together with a diagrammatic representation of the movement of the pendulum showing how the restoring force on the pendulum drops as the pendulum is moved from a rest position;

FIG. 5 is an exploded view of the pendulum of FIGS. 2 and 3 showing its components prior to assembly that permit crimping of a soft metal bar onto the pendulum to provide for a point mass; and FIG. 6 is a schematic representation of a calibration system for use with the present invention.

DETAILED DESCRIPTION OF THE PREFERRED EMBODIMENT

Figure 1:
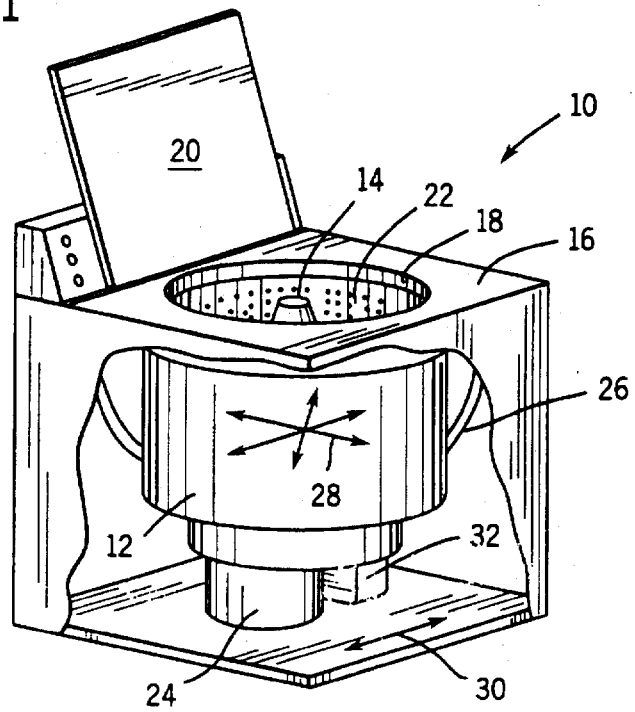
FIG. 1 is a perspective view in cut away of a residential top loading washing machine showing the suspended tub, and its direction of motion in and out-of-balance condition, and showing the mounting of the switch of the acceleration sensitive switch of the present invention near the bottom of that tub.

Referring now to FIG. 1, a top loading washing machine 10 provides generally a tub 12 into which clothes may be loaded and washed under the influence of center agitator 14. Access to the tub 12 is provided through a circular opening in a generally planar and horizontal top 16. The circular opening conforms substantially to the opening of the tub 12, and is ringed by a top flange 18 extending downward from the circular opening a short distance to guide clothes into the tub 12.

A lid 20 is hinged at one edge to swing between an open position providing access to the tub 12 and a closed position horizontally covering the opening of the tub 12. A spin basket 22 is positioned coaxially in the tub 12 to spin the clothes during a spin cycle so that water is forced centrifugally through holes in the spin basket 22 and into the tub 12 for collection and discharge. A motor and transmission unit 24 suspended from the bottom of the tub 12 communicate with the spin basket 22 to spin the same and with the agitator 14 to reciprocate the agitator 14 during the washing cycle.

The tub 12, including the pendant motor and transmission unit 24, may be suspended by one or more pivoting links 26 so that the tub 12 "floats" with respect to the top 16, and the stationary frame of the washing machine 10 to accommodate eccentric motion of the tub 12 under minor out-of-balance conditions indicated by axes 28.

During extreme out-of-balance conditions, one or more dominant modes of motion will typically develop depending on the mechanism used for suspending the tub and the distribution of the tub masses. Although the dominant mode of motion can be at any angle, it will typically be along a known axis for a given design of washing machine 10, for example, as indicated by axis 30 henceforth designated the lateral axis 30. The out-of-balance control 32 of the present invention is preferably mounted to the underside of the tub 12 on the motor and transmission unit 24. Here it may provide an indication that accelerations along the lateral axis 30 have exceeded an accurately controlled predetermined threshold.

Figure 2:
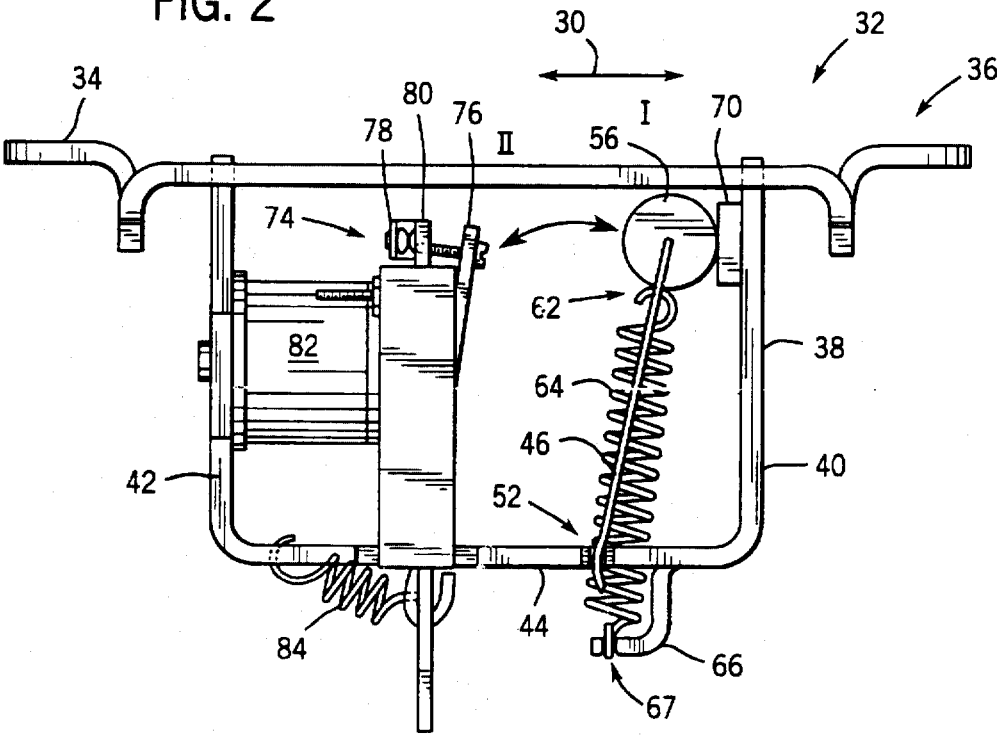
FIG. 2 is a elevation view of the switch of FIG. 1 (with its housing removed for clarity) showing the inverted pendulum structure for activating a set of switch contacts.

Referring now to FIG. 2 and 3 the out-of-balance control 32 includes an upper mounting plate 34 having one or more mounting holes 36 (visible in FIG. 3) to permit the plate 34 to be affixed to the motor and transmission unit 24 in a generally horizontal position. A C-shaped housing 38 attached to and hanging from beneath the plate 34 completes a box-like frame providing mounting surfaces for the various components of the out-of-balance control 32. The surfaces provided by the frame include a right vertical wall 40, a left vertical wall 42, and a horizontal bottom wall 44 generally parallel to but below the plate 34. As the out-of-balance control 32 is mounted on the motor and transmission unit 24, the left and right walls 42 and 40 are disposed along the longitudinal axis 30.

Referring now to FIGS. 2, 3 and 5, a pivot arm 46 formed from a planar C-shaped sheet of metal has lower knife edges 48 formed by the extreme edges of the arms of the C. On either side of the knife edges 48 are arcuate fingers 50 extending downward from the knife edges 48 at a front and back outer edge of the pivot arm 46. The knife edges 48 are received by grooves 52 cut in upper surface of the bottom wall 44 whereas the fingers 50 are received by notches 54 cut at the front and back ends of the grooves 52.

As received in the grooves 52 and notches 54, the knife edges 48 and fingers 50 of the pivot arm 46 are prevented from straight line movement in any direction but upward away from the bottom wall 44. However, the pivot arm 46 is free to pivot about the fulcrum of the knife edges 48 and grooves 52. Grooves 52 are perpendicular to the longitudinal axis 30 so that the pivoting motion of the pivot arm 46 is along the longitudinal axis 30 following a radius about the knife edge 48.

A weight 56 is attached to the edge of the pivot arm opposite the knife edges 48. Preferably, weight 56 is a cylinder of lead having a V-groove 58 cut along one edge so as to permit the weight 56 to fit over the edge of the pivot arm 46 and to be crimped about that edge collapsing the V-groove 58 to press the soft metal of the weight 56 into a set of holes 60 cut near the edge about which the weight 56 is positioned. Significantly, the pivot arm 46 has relatively little mass compared to that of the weight 56 so that the pendulum so created effectively behaves as if the weight were concentrated at a line along its edge.

Between the weight 56 and the knife edge 48, a hole 62 is punched to serve as an attachment point for a helical spring 64. As best seen in FIG. 2, helical spring 64 is placed in tension between a first mounting position at the hole 62 and a second mounting position on a deformable tab 66 extending downward from the bottom wall 44 slightly below the knife edges 48 and displaced slightly toward right wall 40. The placement of the second mounting position will be described in more detail below.

Generally as shown in FIG. 2, the spring 64 will draw the knife edges 48 downward into engagement with the grooves 52 preventing disengagement of the fingers 50 from notches 54 in normal operation. From the first mounting point, spring 64 passes through a channel 68 cut in the bottom wall 44 permitting the spring 64 to pass directly between grooves 52 to hook 67 on deformable mounting tab 66 without interference with the bottom wall 44 of the housing 38.

Referring now to FIG. 4, absent acceleration of the out-of-balance control 32, the weight 56 rests against a pad 70 attached to the inner vertical surface of right wall 40. This pad 70 is constructed of an energy absorbing elastomer such as Sorbothane™ and serves to absorb energy from the weight 56 to prevent it from bouncing under the influence of regular, but low threshold accelerations along the lateral axis 30. As shown in FIG. 3, the pad 70 is further mounted off-center with respect to the weight to allow some of the energy of the weight 56 striking the stop 70 to be dissipated in torsional movement of the pivot arm 46.

Under the force of acceleration, the weight 56 may move along a path (to which the lateral axis 30 is tangent) at a radius R, that radius being determined by the length of the pivot arm 46 between the Center of the weight 56 and the knife edge 48 pivoting about the groove 52. Specifically, a predetermined acceleration (4.1 G's in the preferred embodiment for a specific application) of the out-of-balance control 32 directed from the left wall 42 to the right wall 40 along the lateral axis 30, will cause the weight 56 to swing from its rest position against the pad 70 (designated as position I) to an activation position (designated as position II) where the weight activates a switch 74.

The helical spring 64 holding the knife edges 48 into grooves 52 serves to determine the acceleration of the out-of-balance control 32 required to move the weight 56 from the rest position to the activation position. In particular, the mounting point of hook 67 for the spring 64 is displaced with respect to the fulcrum point of edges 48 and grooves 52 so that the angle A between the axis of tension of the spring 64 (a straight line between hole 62 and hook 67) and the radius provided by pivot arm 46 when the weight 56 is in the rest position (position I) is greater than an angle B between the axis of tension of the spring 64 and the radius of pivot arm 46 when the weight is in the actuation position (position II). In this way, for equal spring tensions, a force vector 57 directed along the longitudinal axis 30 generally perpendicular to the pivot arm 46 will be directed towards the pad 70 and greater in magnitude for position I than position II. Proper selection of angles A and B, by selection of the position of hook 67, will make this true even if the tension of spring 64 is slightly greater for position II than position I as a result of the stretching of the spring 64.

Referring still to FIG. 4, a plot of the force vector 57 vs displacement of the weight 56 from rest position I (measured along the lateral axis 30 and designated by Δ) indicates that the force vector decreases with increasing distance of the weight 56 from the pad 70.

The effect of decreasing force vector 57 is two-fold. First, once the necessary threshold acceleration force is experienced by the weight 56, it travels all the way to the actuation position II having overcome the highest resistive force. It follows, therefore, that for lesser accelerations along the lateral axis 30, the weight 56 does not move at all. For this reason, the instances where the weight leaves the pad 70 only to return without actuating the switch 74 will be minimized reducing the chance that the weight 56 will bounce against the pad 70 coincident with a low acceleration to actuate the switch 74 even though the threshold accelerative force had not been reached. This possibility is further reduced by constructing the stop from an energy absorbing elastomer which decreases the bouncing of the weight 56. The effective time required to accelerate the weight 56 between positions I and II provides a secondary threshold against short duration, but high magnitude accelerations not caused by an out-of-balance condition.

Generally a false indication of an out-of-balance condition is undesirable because it requires the consumer to restart the washing machine.

Referring to FIG. 6, the geometry of the pivot arm 46 with respect to the spring 64 in providing a monotonically decreasing force vector 57 as the weight 56 moves from the pad 70 permits accurate calibration of the out-of-balance control 32 by a measuring of the force necessary to displace the weight 56 a small amount from the pad 70. During calibration a stylus 71 of a force gauge 72 is applied against the weight 56 along the longitudinal axis 30 to just move the weight 56 away from the pad 70. The force so measured is directly related to the acceleration that will trigger the switch and no other positions need be measured.

For example, in the preferred embodiment, it is desired that the switch trigger at 4.1 G's plus or minus 6% applied along the longitudinal axis 30. Because the mass is concentrated at weight 56 which is a known amount, the necessary force read by the force gauge 72 may be readily determined by using the equation $$F=MA$$

where F is the force measured by the force gauge 72, M is the mass of the weight and A is the desired threshold acceleration.

The force measured can be adjusted simply by bending the tab 66 inward or outward along the axis of the spring 64 to increase the spring tension of spring 64. Because the spring tension is in all cases directed in part along the radius of the pivot arm 46, only a fraction of the spring tension increase is translated into the force vector 57 along the axis 30. Thus, this adjustment of tab 66 provides a very sensitive change in force.

Tab 66 can also be bent forward and backwards along the lateral axis to change the lateral location of the second mounting position and thus the degree to which the force vector 57 decreases as the weight 56 moves from the pad 70.

Thus, referring to the plot of FIG. 4, generally adjustment of the tab 66 inward or outward can be used to displaced the curve of vector tension 57 upward or downward without significantly changing its shape, whereas adjustment of the tab laterally changes the shape of the curve of vector tension 57. The lateral adjustment can be used, for example, to increase the rate of vector force "fall off" as the weight 56 moves from the rest position without changing the threshold of acceleration required to initiate that movement.

Referring again to FIG. 2, when the weight 56 moves to the activation position II, it strikes a pivoting armature 76 that communicates with a contact 78 on a flexible strip pushing the contact 78 away from a stationary contact 80 and opening a circuit. The armature 76 is mounted pivotally to move, upon being struck by the weight 56, toward an electromagnet coil 82. A return spring 84 normally pulls the armature 76 away from the electromagnet coil 82 absent any other force.

In a preferred embodiment, the electromagnet coil 82 is wired in series with the motor of the motor and transmission unit 24 shown in FIG. 1. The contacts 78 and 80 thus shunt coil 82 causing it to carry no current during normal operation. When the weight 56 moves from the rest position (position I) to the activation position (position II) striking the armature 76, the contacts 78 and 80 are opened causing current to flow through the electromagnet coil 82 in turn attracting the armature 76 toward the coil 82 and maintaining contacts 78 and 80 open even though the weight 56 returns to the rest position.

Because the energizing current for the coil 82 is AC, the armature will normally vibrate causing a buzzing sound, but will nevertheless maintain contacts 78 and 80 open, preventing operation of the drive motor, until power is removed from the coil 82 by the user of the washing machine 10 thus resetting the washing machine 10 after adjustment of its load. The mechanism of the electromagnet coil 82 and contacts 78 and 80 are similar to those described in U.S. Pat. Nos. 3,958,094, and 3,815,086 hereby incorporated by reference. It will be understood in the art that this same operation may be achieved without the buzzing sound by "shading" the core of the electromagnet with a conductive ring to provide a continuously attractive force during AC operation The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made.

I claim:

1. An out-of-balance control for detecting lateral housing motion comprising:

a weight mounted for movement in a lateral direction between a rest position and an activation position to move independently of the housing in response to lateral housing motion;

an electrical switch positioned at the activation position so as to be actuated when the weight has moved to the activation position;

a stop located at the rest position to contact the weight when the weight has moved to the rest position; and a spring attached to the weight for biasing the weight toward the stop with a threshold force that decreases as the weight moves away from the stop so that in the absence of other lateral forces, a non-zero predetermined acceleration of the housing in the lateral direction is required to cause the weight to move to the activation position to activate the switch.

2. The out-of-balance control of claim 1 wherein the stop is energy absorbing.

3. The out-of-balance control of claim 2 wherein the stop is an energy absorbing elastomer.

4. The out-of-balance control of claim 1 wherein the electrical switch includes a magnetically attractable operator co-acting with switch contacts, and wherein the switch contacts are connected to a electromagnet positioned to attract the magnetically attractable operator whereby activation of the electrical switch causes a latching condition of the switch in an activated state.

5. The out-of-balance control of claim 4 wherein in the switch contacts are opened by movement of the weight to the activation position, and wherein the switch contacts are connected in series across the electromagnet so that a voltage connected across the contacts will cause the attraction of the magnetically attractable operator to the coil holding open the switch contacts until the voltage is removed.

6. The out-of-balance control of claim 5 wherein in the coil includes a shading ring to provide continuous attraction of the magnetically attractable operator when the coil is energized with AC currents.

7. An out-of-balance control for detecting lateral motion of a housing comprising:

a weight mounted for movement in a lateral direction with respect to the housing between a rest position and an activation position;

an electrical switch positioned at the activation position so as to be actuated when the weight has moved to the activation position;

a stop located at the rest position to contact the weight when the weight has moved to the rest position; and a spring attached to the weight for biasing the weight against the stop with a threshold force so that in the absence of other lateral forces, a non-zero predetermined acceleration of the device in the lateral direction is required to cause the weight to move to the activation position to activate the switch;

wherein the weight is mounted on a pivoting arm to move in the lateral direction about a fulcrum point on the housing, and wherein the spring is attached in tension between a first mounting point near the weight and a second mounting point on the housing between the weight and the fulcrum point to draw the arm toward the fulcrum point.

8. The out-of-balance control of claim 7 wherein the second mounting means is a deformable tab.

9. The out-of-balance control of claim 7 wherein the fulcrum point is positioned on the housing so that a line between the second mounting point and the weight approaches the fulcrum point as the weight moves toward the activation position.

10. A method of calibrating an out-of-balance control for detecting lateral housing motion, the control including a weight mounted for movement in a lateral direction with respect to the housing between a rest position and an activation position, an electrical switch positioned at the activation position so as to be actuated when the weight has moved to the activation position, a stop located at the rest position to contact the weight when the weight has moved to the rest position, a spring attached between the weight and a spring mounting point fixed with respect to the housing for biasing the weight toward the stop in the absence of other lateral forces the spring providing a force of biasing of the weight toward the stop that decreases as the weight moves away from the stop, the method comprising the steps of:

a) displacing the weight by a predetermined distance from the stop position in the absence of other lateral forces; and b) adjusting the spring biasing to a predetermined biasing force.

11. The method of claim 10 wherein the weight of the out-of-balance control is mounted on a pivoting arm to move in the lateral direction about a fulcrum point on a housing and wherein the spring is attached in tension between a first mounting point near the weight and a second mounting point on the housing between the weight and the fulcrum point to draw the arm toward the fulcrum point and wherein the second mounting means is a deformable tab, and wherein step (b) comprises bending the deformable tab.

12. The method of claim 11 including the step of:

c) bending the deformable tab in the lateral direction to a predetermined position with respect to the fulcrum to control a rate of decrease in the biasing of the weight toward the stop, in the absence of other lateral forces, as the weight moves from the stop.

* * * * *